US006653983B2

(12) United States Patent
Masuda et al.

(10) Patent No.: US 6,653,983 B2
(45) Date of Patent: Nov. 25, 2003

(54) ANTENNA AND INFORMATION PROCESSORS

(75) Inventors: Kazuo Masuda, Kanagawa-ken (JP); Akihisa Sakurai, Kanagawa-ken (JP)

(73) Assignee: International Business Machines Corporation, Armonk, NY (US)

( * ) Notice: Subject to any disclaimer, the term of this patent is extended or adjusted under 35 U.S.C. 154(b) by 23 days.

(21) Appl. No.: 09/682,666

(22) Filed: Oct. 3, 2001

(65) Prior Publication Data

US 2002/0060647 A1 May 23, 2002

(30) Foreign Application Priority Data

Oct. 3, 2000 (JP) ..... 2000-304108

(51) Int. Cl.[7] ..... H01Q 13/10
(52) U.S. Cl. ..... 343/767; 343/702
(58) Field of Search ..... 343/702, 767, 343/769, 770, 768; H01Q 13/10

(56) References Cited

U.S. PATENT DOCUMENTS 4,023,179 A * 5/1977 Ikrath et al. ..... 343/713
5,012,255 A * 4/1991 Becker ..... 343/704
5,353,038 A * 10/1994 Osborne et al. ..... 343/708
5,355,144 A * 10/1994 Walton et al. ..... 343/713

* cited by examiner

*Primary Examiner*—Tho Phan
(74) *Attorney, Agent, or Firm*—Derek S. Jennings

(57) ABSTRACT

An aperture antenna is provided so that it is capable of matching with a standardized coaxial cable without employing any matching circuit. The aperture antenna includes a first flat electric conductor 2*a* with an aperture in which a second aperture length in a second direction perpendicular to a first direction is greater than a first aperture length in the first direction. A second electric conductor, spaced from the first electric conductor is disposed inside the aperture in practically the same plane with the first electric conductor. Further included is a non-balance type transmission line.

10 Claims, 7 Drawing Sheets

ANTENNA AND INFORMATION PROCESSORS

BACKGROUND OF INVENTION

1. Field of the Invention

The present invention relates to antenna and information processors, and more particularly to an antenna structure effective when applied to a mobile computer system such as a notebook-sized personal computer, etc.

2. Background Art

With the spread of the utilization of Internets, Intranets and other intra-office networks, much interest and a great deal of effort have recently been devoted to radio communication devices for personal computer (PC) users to connect to a telephone network or local area network (LAN). In addition, with practical use and generalization of the Bluetooth standard, radio communication devices with high utilization have positively been developed.

Antennas are very important in radio communication techniques along with transceivers. The antenna, as is well known, is a device to radiate and detect an electronic wave efficiently, and a wide variety of antennas are known. For instance, a vertical antenna (unipolar antenna) and a dipole antenna are known as linear antennae, and a loop antenna and a folded antenna are known as line antennae. A slot antenna (aperture antenna), a bipolar antenna, and a horn antenna are known as solid-state antennae. In applying these antennae to computers, or a multiplicity of devices meeting the Bluetooth standard, it is necessary to take into consideration a reduction in the device manufacturing cost, ease in assembling, convenience during operation, reliability, etc., as well as a reduction in a mounting space.

Because of this, aperture antennae (slit antennae) have been adopted in equipment, which is limited in mounting volume, such as notebook-sized personal computers, etc. The aperture antenna is constructed of a thin metal plate having a predetermined size of slit (aperture). It has excellent costs because machining is easy and is excellent in mounting as it can be mounted in a small volume. In addition, if it is given a certain degree of mechanical strength, it can be utilized as a component supporting member and therefore it can make a contribution to a reduction in the number of steps. Furthermore, an antenna element does not protrude as it does in the case of a linear antenna such as a dipole or unipolar antenna. Therefore, appearance can be enhanced from the viewpoint of design, and an unexpected accident due to catching, etc., of the protruding portion during operation can also be prevented.

However, it is difficult to perform impedance matching between an aperture antenna and a transmission line without employing any matching element. In general, the matching between an aperture antenna and a transmission line (cable) is done by a method of finding out the optimal driving point of the cable by experiment or simulation. This method is possible when a difference impedance with the cable is not large. Since, however, the radiation resistance of an ordinary aperture antenna is high such as 500 Ω to 5000 Ω, proper impedance matching cannot be performed, unless an impedance matching circuit (element), such as a transformer, etc., is inserted between a cable and an antenna. Insertion of the impedance matching element results in an increase in the mounting volume, as well as a rise in costs resulting from an increase in the number of components and the number of manufacturing steps. Particularly, applications in products, which have limited mounting volume, such as a portable information terminal, etc., are not preferable.

Besides, it is fairly difficult to determine the optimal position of the aforementioned driving point. More specifically, as impedance is largely changed by a slight change in the driving point, there is a need to determine the driving point precisely. This makes the design of produces difficult, and also requires high machining accuracy, resulting in a rise in the manufacturing cost. Furthermore, an ordinary aperture antenna is narrow in band. Particularly, in the case where it is used with a frequency in the order of GHz, antenna characteristics are degraded by changes in machining dimensions. An enhancement in machining precision increases manufacturing costs, as described above. Even if the aperture antenna is manufactured with a high degree of machining precision, it cannot be used in a band offset from the designed wavelength and will be inferior in convenience.

In addition, in an ordinary aperture antenna, driving voltage (current) is applied between both ends of the aperture. Because of this, the electric potential across a metal plate with an aperture is not statically fixed like ground potential. This means that it tends to undergo the influence of the surrounding potentials, and can be the cause of unstable antenna characteristics.

On the other hand, it is considered that another antenna can be used instead of the aperture antenna. However, in the case of a dipole antenna, for example, it increases the number of components, and if it is mounted inside a device, it will increase a mounting volume. If it is projected from a device, the aforementioned disadvantages will arise. Other antenna elements also have similar disadvantages.

It is an object of the present invention to provide an aperture antenna that is capable of matching with a cable (transmission line) without employing any matching circuit (matching element). Another object is to provide an aperture antenna that is capable of allowing slight fluctuations in machining. Still another object is to provide an aperture antenna in which its operating band is broad. Yet a still another important object is to provide an aperture antenna, which is less liable to be affected by the influence of operating circumstances or surrounding electric fields.

SUMMARY OF INVENTION

An antenna according to the present invention is schematically constructed as follows:

A feature of the present invention includes an antenna having a first flat electric conductor with an aperture in which a second aperture length in a second direction perpendicular to a first direction is greater than a first aperture length in the first direction. A second electric conductor, spaced from the first electric conductor is disposed inside the aperture in practically the same plane with the first electric conductor. A non-balance type transmission line has its signal line connected to the second electric conductor and its ground line connected to the first electric conductor. The center-to-center distance, in the second direction, of a gap between the first and second electric conductors is one half an electrical length in the frequency band of an electronic wave signal radiated.

Various other objects, features, and attendant advantages of the present invention will become more fully appreciated as the same becomes better understood when considered in conjunction with the accompanying drawings, in which like reference characters designate the same or similar parts throughout the several views.

DETAILED DESCRIPTION

Figure 1:
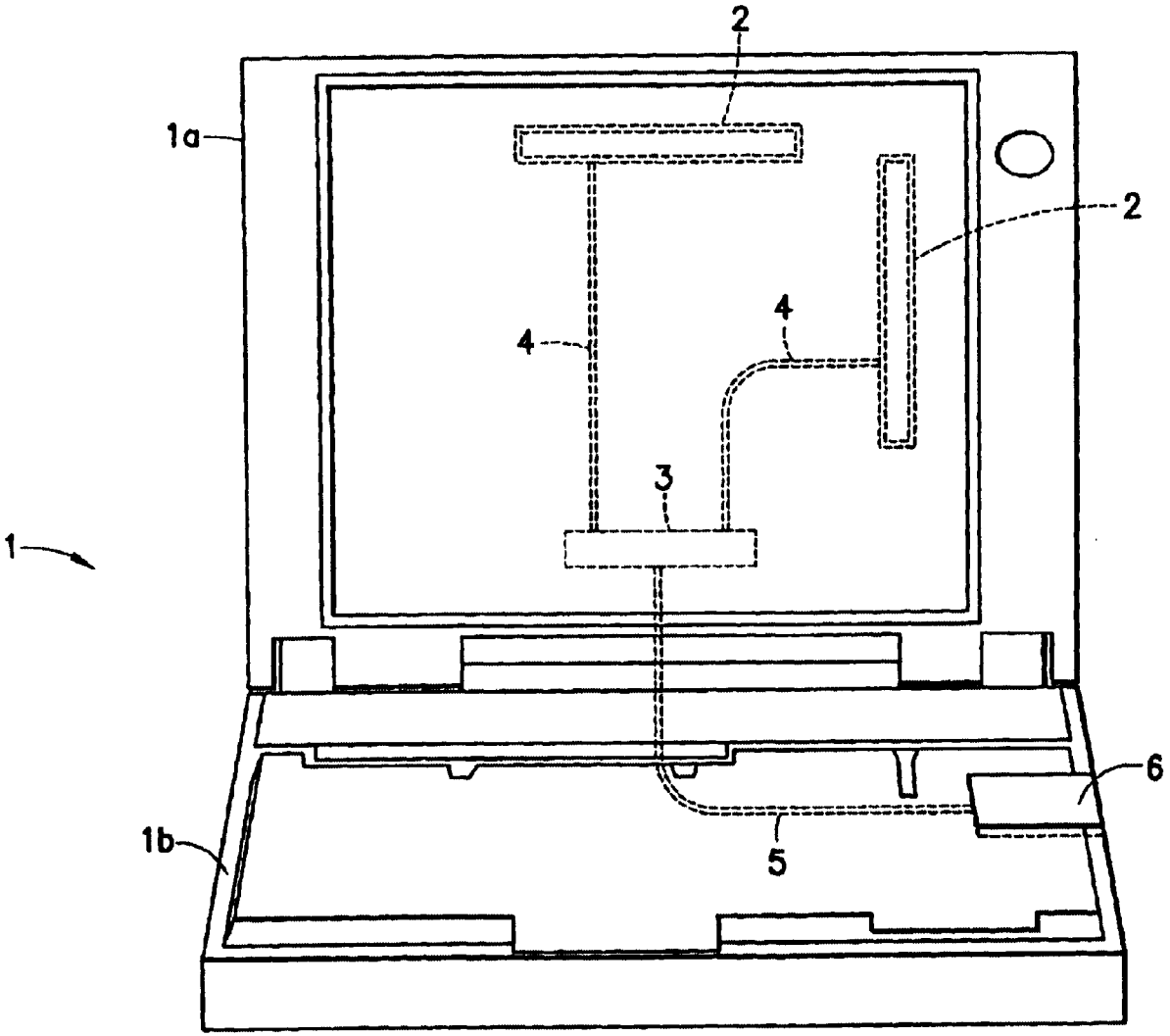
FIG. 1 is a diagram showing an example of a computer system to which antennae according to the present invention are applied.

The antenna of the present invention constitutes an aperture antenna having a gap, which corresponds to the conductive portion of a folded antenna the first and second electric conductors. (The aperture antenna will hereinafter be referred to as a folded aperture antenna.) By constructing such a folded aperture antenna, the radiation resistance can be reduced. That is, practical impedance matching with the transmission line (cable) becomes possible without a matching element. In addition, in the folded aperture antenna, the Q-value of resonance can be reduced, so the bandwidth of the antenna can be made broader. Moreover, a reduction in the Q-value reduces the accuracy of the position (driving point) of a signal line, which is connected to the aperture antenna. That is, even if there are slight machining fluctuations, stable antenna characteristics can be obtained. Furthermore, in the folded aperture antenna of the present invention, the electric conductor (first electric conductor) with an aperture is maintained at ground potential. As the electric potential on the main components of the antenna is stably maintained at the ground potential, the antenna is less likely to undergo the influence of an external electric potential. Because of this, an antenna with high reliability can be constructed by suppressing fluctuations in antenna characteristics due to surrounding circumstances.

Note that in the aperture a plurality of second electric conductors may be spaced in the first direction and disposed. In addition, the signal line is connected to the center portion, in the second direction, of the second electric conductor. Furthermore, the sizes of the parts of the antenna can be exemplified. The center-to-center distance, in the first direction, of a gap between the first and second electric conductors, or between the plurality of second electric conductors is in a range of 1/10 to 1/25 of the electrical length. The space of the gap is in a range of 1/50 to 1/150 of the electrical length. The size, in the first direction, of the first electric conductor is 1/8 or more of the electrical length, and a size, in the second direction, of the first electric conductor is 5/8 or more of the electrical length.

In addition, the aperture and second electric conductor may be rectangular in shape. The first and second electric conductors may be metallic films formed on a printed circuit board. Note that the band of the folded aperture antenna can be made ±0.11 or more, if it is assumed that it is in a range of radiant frequencies where the voltage standing wave ratio standardized with a center frequency is maintained at 2 or less.

Preferred embodiments of the present invention will hereinafter be described with reference to the drawings. However, the present invention can be implemented in many widely different embodiments and is not to be interpreted as being limited to the specific embodiments described in this specification. Note that the same reference numerals will be applied to the same parts throughout the preferred embodiment.

FIG. 1 illustrates an example of a computer system to which an antenna according to the present invention is applied. The computer system of the preferred embodiment is a notebook-sized personal computer system. The computer system 1 is constructed of a cover portion 1*a*, in which a liquid crystal display, peripheral circuitry, a back light, etc., are stored, and a main body portion 1*b* in which a mother keyboard, a keyboard, a hard-disk drive, a CD-ROM drive, a floppy-disk drive, etc., are stored.

The housing between the cover portion 1 a and the main body portion 1*b* is formed, for example, with resin such as acrylonitrile butadiene styrene copolymer (ABS) resin, etc. Antennas 2 are disposed interiorly of the cover portion 1*a*, for example, between the housing and the backlight. The antennas 2 are disposed for vertically and horizontally polarized waves in the vertical and horizontal directions, respectively. These antennas 2 will be described in detail later. Which antenna is selected is selected by a switch 3 in accordance with the strength of a received electronic wave signal. The antennas 2 are connected with the switch 3 through coaxial type high-frequency cables 4. Note that in this embodiment, two antennas 2 are disposed, but a single antenna 2 may be disposed. A single antenna 2 can be disposed in the horizontal, vertical, or diagonal direction. In this case the switch 3 is unnecessary. In addition, the antennae may be disposed at any position. While, in this embodiment, the antennas 2 are disposed on the cover portion 1*a*, they can also be disposed on the bottom surface of the main body portion 1*b*, etc.

The switch 3 is connected with a coaxial type high frequency cable 5, which is in turn connected to a radio device 6. The radio unit 6 is constructed, for example, of a PC card, etc., which meet the personal computer memory card international association (PCMCIA) standard. In this embodiment, the high-frequency cable 5 and the radio device 6 are connected within the main body portion 1*b*, but the high-frequency cable 5 may be extended outside the main body portion 1*b* and connected with a radio unit 6 disposed outside the main body portion 1*b*. In addition, the radio device 6 is not limited to the PC card. The radio device 6 may be constructed by a device meeting a standard other than the PCMCIA standard, or a nonstandard device.

The high-frequency cables 4, 5 each have a center conductor 4*a* and an outer conductor 4*b*. The outer conductor 4*b* is constructed coaxially with the center conductor 4*a*, and a dielectric is inserted therebetween. The high frequency cables 4, 5 are constructed in size and material meeting a standard. It is preferable that the high-frequency cables 4, 5 be as fine as possible. However, the thickness is arbitrary. The characteristic impedance of the high-frequency cables 4, 5 is, for example, 50 Ω or 75 Ω. In FIG. 1 the high-frequency cable 5 is illustrated to pass through the central portions of the cover portion 1*a* and the main body portion 1*b*, but those portions through which the cable 5 passes are arbitrary. For instance, it may pass through the opposite hinges between the cover portion 1*a* and the main body portion 1*b*.

Figure 2:
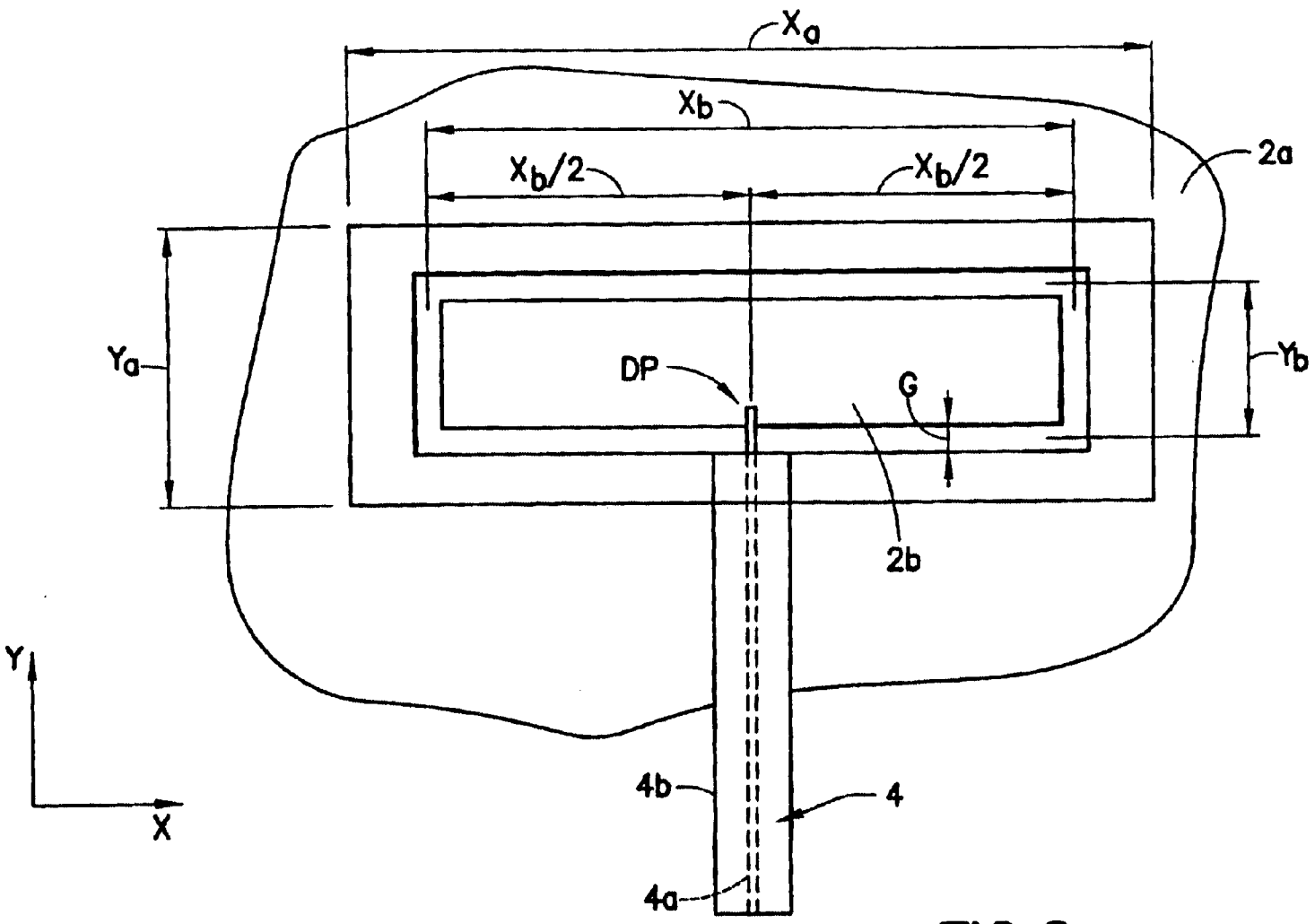
FIG. 2 is an enlarged plan view showing the antenna.

FIG. 2 shows an enlarged plan view of the antenna 2. The antenna 2 is constructed with a first electric conductor 2*a* having an aperture, and a second electric conductor 2*b* disposed inside the aperture. The aperture has a length in an x-direction greater than a length in a y-direction. Both the first electric conductor 2*a* and the second electric conductor 2*b* are approximately flat, and the second electric conductor 2*b* is disposed on practically the same plane as the first electric conductor 2*a*. Here, the expression "practically the same plane" refers to the same within a range including dimensional errors that is negligible compared with the wavelength of an electro-magnetic wave transferred or radiated. More specifically, the first electric conductor 2*a* and the second electric conductor 2*b* need not be accurately disposed in the same plane, and a vertical offset with respect to the paper surface of FIG. 2 is allowed as an offset that is negligible compared with radiation wavelength. In the case where radiation wavelength is a few cm to a few tens cm, for instance, an offset of about a few mm is allowed as the vertical offset with respect to the paper surface. In this case both electric conductors are practically in the same plane.

The first electric conductor 2*a* is connected with the outer conductor 4*b* of the high-frequency cable 5, and the second electric conductor 2*b* is connected at its center portion in the x-direction with the center conductor 4*a* of the high-frequency cable 5. This connection portion becomes a driving point DP to which current-voltage that becomes the radiation energy of an electro-magnetic wave is applied. In FIG. 2, the position of the driving point DP is illustrated at the center point, in the x-direction, of the second electric conductor 2*b*, but a slight offset is allowable. This is because, as described later, the Q-value of the resonance of the antenna 2 is not great and therefore the positional accuracy of the driving point is not required compared with ordinary aperture antennae. For this reason, the antennae of this embodiment can be manufactured with a relatively low degree of accuracy and it becomes possible to reduce the manufacturing cost. In addition, in the antennae of this embodiment, no impedance matching elements are inserted between the high-frequency cable 4 and the antennas 2. The reason the cables 4 are connected directly with the antennas 2 is that, as described later, the antennas 2 of this embodiment can be reduced in impedance, compared with conventional aperture antennae.

Figure 3:
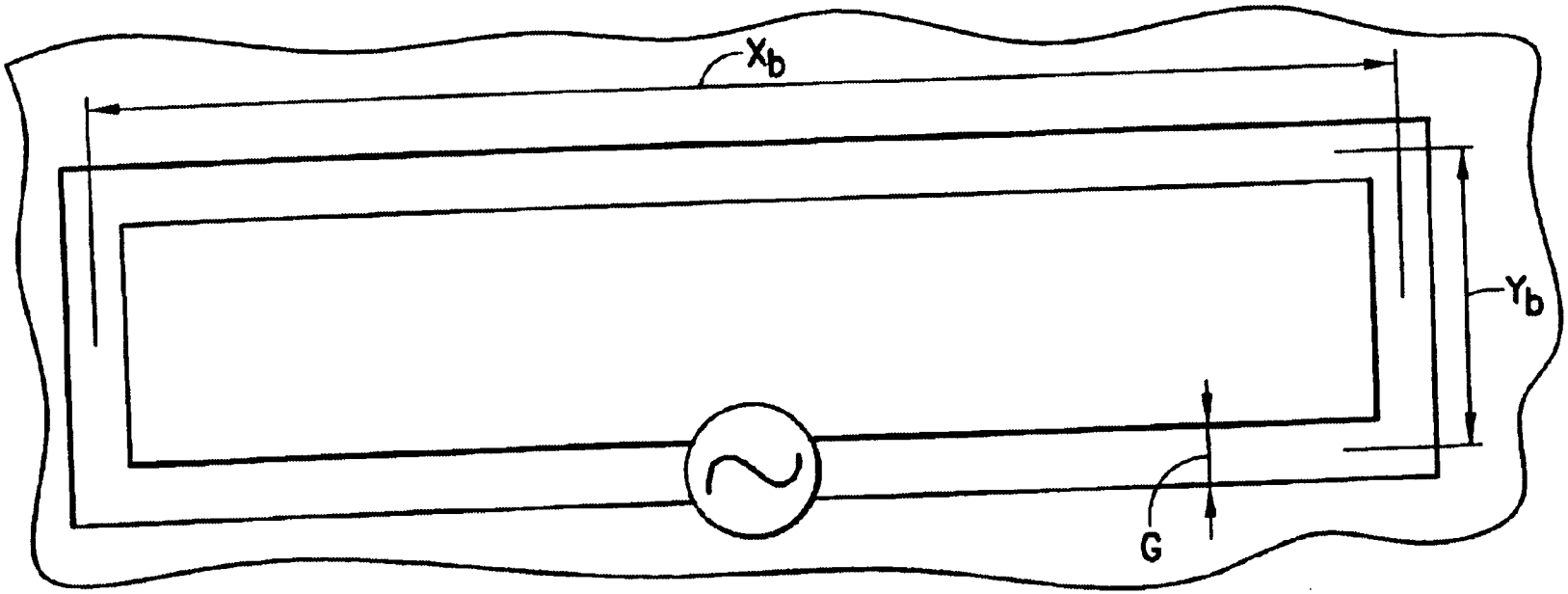
FIG. 3 is a diagram showing an example of a folded dipole antenna.

As shown in the foregoing description and FIG. 2, the antennas 2 have the slit (aperture) between the first electric conductor 2*a* and the second electric conductor 2*b*, the configuration of this slit being the same as the electric conductor portion of a folded dipole antenna shown in FIG. 3. From the electric potential applied across each conductor and the disposition of the aforementioned conductors, the antennas 2 of this embodiment results in the dual circuit of the folded dipole antenna shown in FIG. 3. The self-impedance of the antennas 2 in this embodiment is expressed as follows:

First, a known folded dipole antenna is expressed with a 4-terminal circuit, and the Z-matrix (impedance parameter) in this circuit is defined like Expression 1.

Expression 1

$$\begin{bmatrix} V_1 \\ V_2 \end{bmatrix} = \begin{bmatrix} Z_{11} Z_{12} \\ Z_{21} Z_{22} \end{bmatrix} = \begin{bmatrix} I_1 \\ I_2 \end{bmatrix} \quad \text{[Expression 1]}$$

Because a reciprocity theorem is established, $Z_{12}$ equals $Z_{21}$. If the Z-matrix is expressed in terms of an F-matrix (4 terminal constants), it is like Expression 2.

Expression 2

$$\begin{bmatrix} A' & B' \\ C' & D' \end{bmatrix} = \frac{1}{z_{21}} \begin{bmatrix} Z_{11} & |Z| \\ 1 & Z_{22} \end{bmatrix} \quad \text{[Expression 2]}$$

where $|Z|$ is the value of the Z-matrix. The F-matrix of the antennas 2, which is the dual circuit, is like Expression 3.

Expression 3

$$\begin{bmatrix} AB \\ CD \end{bmatrix} = \begin{bmatrix} D'C'R^2 \\ \frac{B'}{R^2} A' \end{bmatrix} = \frac{1}{z_{21}} \begin{bmatrix} Z_{22} R^2 \\ \frac{|z|}{R^2} Z_{11} \end{bmatrix} \quad \text{[Expression 3]}$$

If a transformation is made from the F-matrix to the Z-matrix, Expression 4 is obtained.

Expression 4

$$\begin{bmatrix} Z'_{11} & Z'_{12} \\ Z'_{21} & Z'_{22} \end{bmatrix} = \frac{1}{C} \begin{bmatrix} A & 1 \\ 1 & D \end{bmatrix} = \frac{R^2}{|z|} \begin{bmatrix} Z_{22} & Z_{21} \\ Z_{21} & Z_{11} \end{bmatrix} \quad \text{[Expression 4]}$$

Thereby, a mutual impedance of the dual circuit is expressed as Expression 5.

Expression 5

$$Z^c_{21} = Z'_{12} = Z'_{21} = \frac{R^2}{|z|} Z_{21} \quad \text{[Expression 5]}$$

The value of R is determined by the complement theorem of the antenna shown in Expression 6.

Expression 6

$$Z_{11} Z'_{11} = Z_{22} Z'_{22} = \frac{1}{4} \frac{\mu}{\varepsilon} = 3600\pi^2 \quad \text{[Expression 6]}$$

With this, $R^2$ is calculated as shown in Expression 7.

Expression 7

$$\frac{R^2}{|z|} Z_{11} Z_{22} = 3600\pi^2 \quad \text{[Expression 7]}$$

$$R^2 = 3600\pi^2 \frac{|z|}{z_{11} z_{22}}$$

The impedance parameters of the dual circuit are calculated as shown in Expression 8.

Expression 8

$$Z^C_{21} = \frac{R^2}{|z|} Z_{21} = 3600\pi^2 \frac{z_{21}}{z_{11} z_{22}} \quad \text{[Expression 8]}$$

$$Z^C_{11} = \frac{R^2}{|z|} Z_{22} = 3600\pi^2 \frac{1}{z_{11}}$$

-continued $$Z_{22}^{C} = \frac{R^2}{|z|} Z_{11} = 3600\pi^2 \frac{1}{z_{22}}$$

Therefore, the Z-matrix $|Z^C|$ of the dual circuit is calculated as shown in Expression 9.

Expression 9

$$[Z^C] = 3600\pi^2 \begin{bmatrix} \frac{1}{z_{11}} & \frac{z_{21}}{z_{11} z_{22}} \\ \frac{z_{21}}{z_{11} z_{22}} & \frac{1}{z_{22}} \end{bmatrix} \quad \text{[Expression 9]}$$

The input impedance (self-impedance) of the antenna is given as shown in Expression 10 because it is the $Z_{11}$ component of the impedance matrix (Z-matrix).

Expression 10

$$Z_{11}^{C} = \frac{R^2}{|z|} Z_{22} = 3600\pi^2 \frac{1}{z_{11}} \quad \text{[Expression 10]}$$

For instance, the radiation impedance of a half-wave dipole antenna folded once becomes 2920 Ω, because it is 4 times that of a non-folded half-wave dipole antenna. The aperture antenna of this embodiment becomes 90.7 Ω, since it becomes the dual circuit of a half-wave dipole antenna which is folded once. This value does not largely differ from the standardized value of a coaxial cable, which is 75 Ω. For this reason, practical impedance matching becomes possible by a direct connection.

The dimensions of the antenna 2 are as follows. The center-to-center distance Xb, in the x-direction, of the gap formed by the first and second electric conductors 2*a*, 2*b* is λ/2. The center-to-center distance Yb, in the y-direction, of the gap is in a range of λ/10 to λ/25. The gap space G is in a range of λ/50 to λ/150. In addition, the minimum dimensions of the first electric conductor 2*a* are 5 λ/8 in the x-direction and λ/8 in the y-direction. The first electric conductor 2*a* will be satisfied if it has the aforementioned dimensions, with the aperture as center. Of course, it may have dimensions greater than that. These numerical values are preferred values, or in the preferred range, obtained by the inventors of this specification. However, these values are merely examples. It is a matter of course that other numerical values can be selected according to the required characteristics of antennae to be used. Note that λ is an electrical wavelength. It is also a matter of course that the electrical wavelength λ varies with the dielectric constant ϵ of a medium and that the relationship between ϵ and λ is λ=o//λ where λ o is wavelength in vacuum.

The first and second electric conductors 2*a*, 2*b* can be constructed, for example, with copper plates. However, any metal material may be employed if it is an electric conductor such as metal, etc. In addition, the conductors 2*a*, 2*b* are not limited to metal, but may employ oxide transparent conductors such as ITO, $SnO_2$, etc. For instance, oxide transparent conductors, which are employed as transparent electrodes within a liquid crystal panel, may be mounted as antennae within the liquid crystal panel. Furthermore, the first and second electric conductors 2*a*, 2*b* may be constructed with wiring metal patterns that are formed on a printed circuit board. For example, they may be constructed with a copper pattern that is formed on a board such as glass epoxy, etc.

According to the antenna described above, as with ordinary aperture antennae, the mounting volume can be reduced. In the case where it is constructed with a copper plate, etc., the thickness can be reduced to 1 mm or less. Furthermore, in the case where it is mounted within a liquid crystal panel, an increase in the volume is equal to zero. In the case where it is mounted on a printed circuit board, no increase in the volume occurs, as long as it is mounted on the marginal portion of the printed circuit board. Even in the case where it is mounted on a dedicated printed circuit board, the thickness can be reduced to 1 mm or less.

In addition, in the antenna of this embodiment, the first and second electric conductors 2*a*, 2*b* are connected directly with the high-frequency cable 4. Therefore, no circuit (or element) for impedance matching is required. Because of this, the number of components can be reduced and the mounting volume (thickness) can be made practically equal to the cable diameter.

Besides, since the first electric conductor 2*a* is always maintained at ground potential, as compared with an ordinal slot antenna it is less liable to be affected by the surrounding potentials. Because of this, stable antenna characteristics are obtainable. Furthermore, an electronic wave signal is transferred in non-balance type from the radio unit 6 to the antenna 2, as they are connected directly with the coaxial cables 4, 5. For example, in the case of connecting the radio unit 6 with a dipole antenna, it is necessary to connect a balancer (also called a balun) therebetween to convert a non-balance type to balance a type. However, this embodiment requires no balancer like this.

Figure 4:
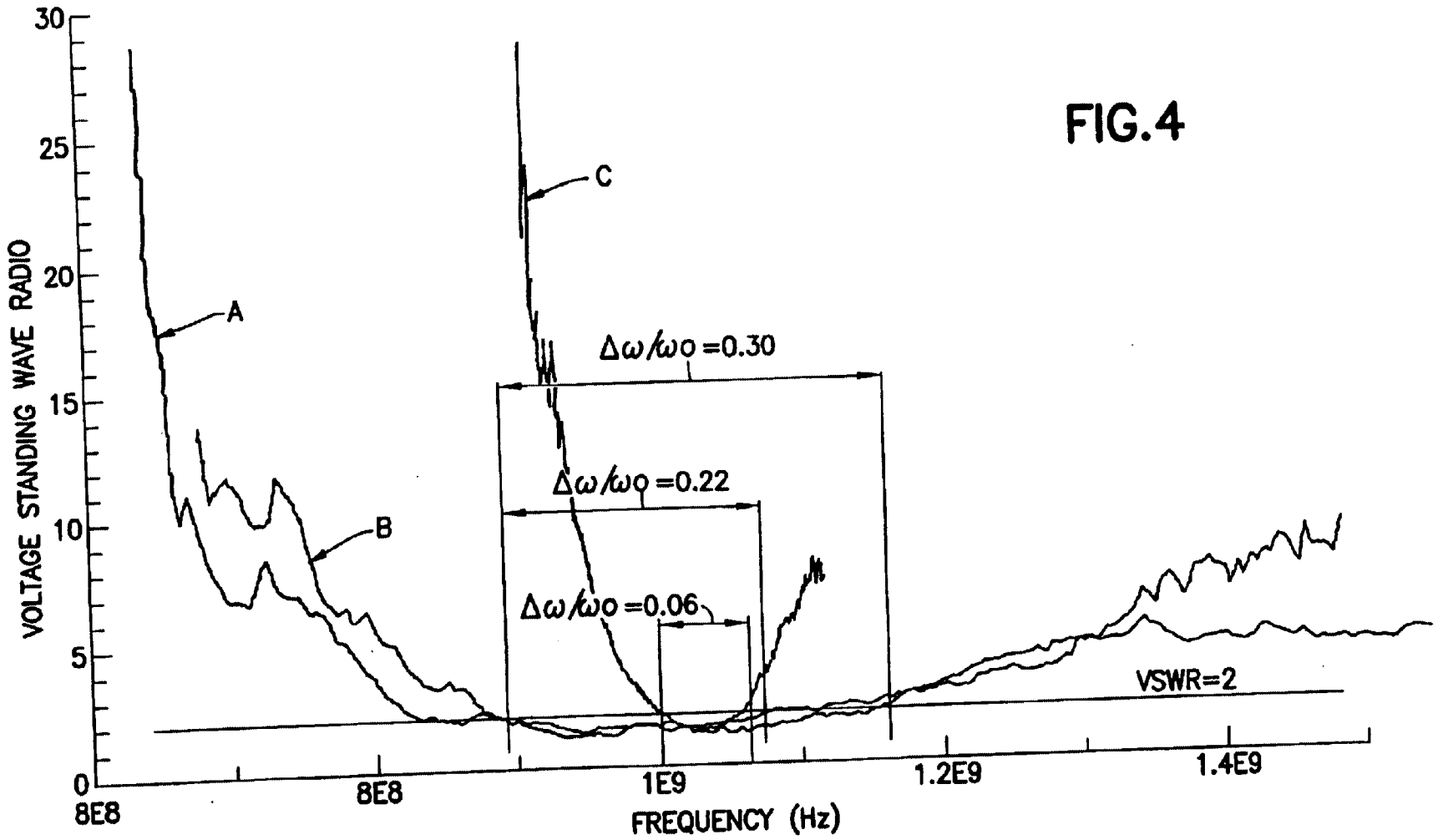
FIG. 4 is a graph showing the measured values of a voltage standing wave ratio (VSWR) of the antenna in this embodiment, as compared with other antennae.

Furthermore, the antenna in this embodiment has a broad bandwidth. FIG. 4 shows a graph of the measured values of the voltage standing wave ratio (VSWR) of the antenna in this embodiment, compared with other antennae. Reference character A denotes the antenna 2 of this embodiment, B a dipole antenna of diameter 3 mm, and C a conventional slot antenna. B and C are shown for comparison. Note that the line diameter of the dipole antenna B is thicker such as 3 mm, compared with wavelength. As an example, a dipole with a relatively broad bandwidth is shown. Here, the bandwidth is defined as Δω/ωo where Δω is a VSWR of 2 or less and Δω o is the center frequency.

As illustrated in FIG. 4, the Δω/ωo for the antenna 2(A) in this embodiment is 0.30. On the other hand, the Δω/ω o for the conventional slot antenna (C) is 0.06. It is found that the band of the antenna 2 in this embodiment has largely widened. The Δω/ωo for the dipole antenna (B) with a relatively broad bandwidth is 0.22. The antenna 2 in this embodiment has a bandwidth, which is about 1.5 times that of the dipole antenna (B) having a relatively broad bandwidth.

The reason why the bandwidth of the antenna 2 in this embodiment widens is as follows: Although the radiation resistance of an ordinary, folded dipole antenna becomes 4 times that of a line dipole antenna, the reactance component remains unchanged and has the same resonance frequency. Because of this, the Q-value of the folded dipole antenna becomes smaller compared with the line dipole antenna. This means that the bandwidth of the folded antenna becomes broader as compared with the dipole antenna. In a dual circuit, on the other hand, the radiation resistance and the reactance component are both converted in the same ratio, and the Q-value, which is the ratio of the radiation resistance and the reactance component, remains unchanged. Therefore, in the antenna 2 of this embodiment, the Q-value becomes smaller and the bandwidth becomes greater, compared with the dipole antenna. Such a reduction in the Q-value means that the standing wave ratio is not changed by a slight change in dimensions (including movement of the driving point) and, even if the manufacturing dimensional accuracy is reduced, antenna characteristics will not largely change.

In the antenna 2 of this embodiment, the bandwidth can be widened while maintaining the Q-value constant, as previously described, and furthermore, a folded antenna with a high input impedance can be reduced down to the input impedance by dual conversion. As a consequence, no matching device is required as described above and practical impedance matching is made possible, and furthermore, an antenna can be constructed which is capable of permitting a slight reduction in dimensional accuracy by widening the bandwidth. Note that the broadness of the bandwidth corresponds to the advantage that a transmittable-receivable frequency range can be widened.

While the present invention has been described with reference to the preferred embodiment thereof, the invention is not to be limited to the details given herein, but may be modified within the scope of the invention claimed.

Figure 5B:
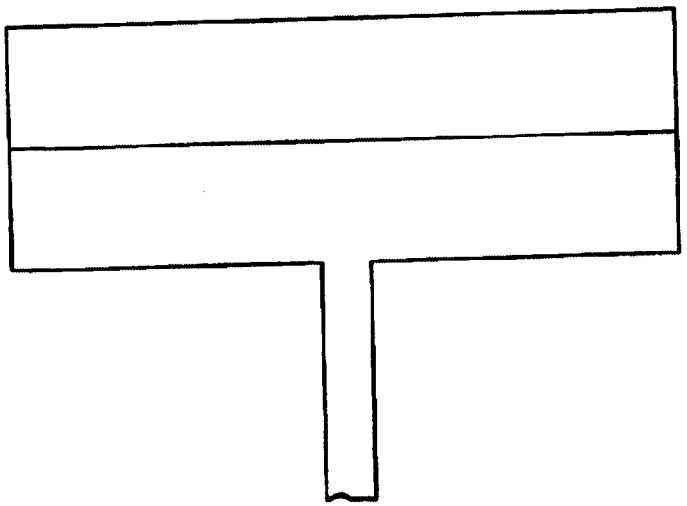
FIG. 5B is a diagram showing a double folded dipole antenna that is the dual circuit.
Figure 5A:
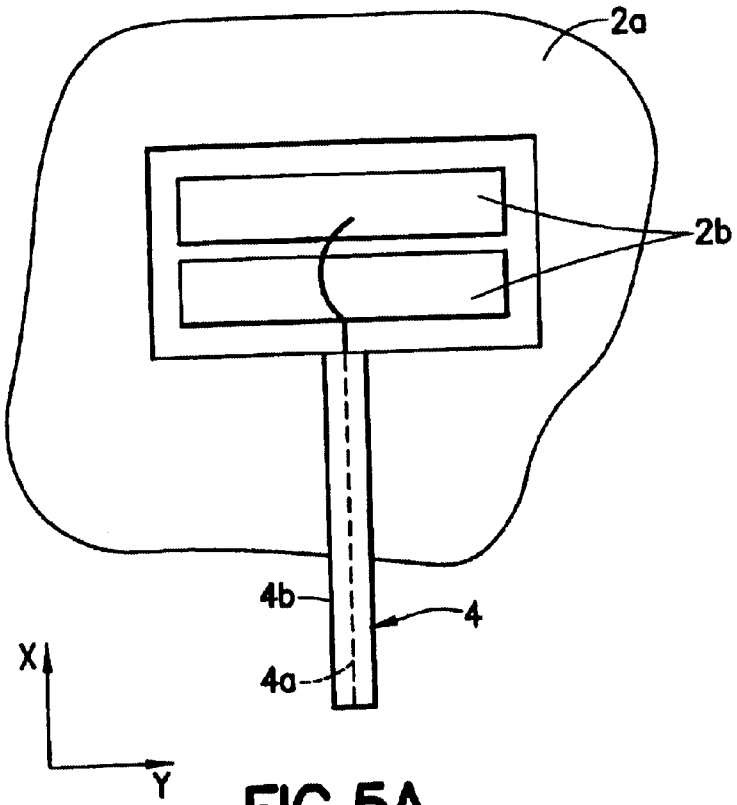
FIG. 5A is a plan view showing an example of another antenna of the present invention.

For example, although, in the aforementioned embodiment, the antenna 2 corresponding to the dual circuit of a single folded dipole antenna has been described, an antenna (FIG. 5A) corresponding to the dual circuit of a double folded dipole antenna (FIG. 5B) such as the one shown in FIG. 5 may be constructed. In this case two spaced second electric conductors 2*b* are disposed in the aperture of the first electric conductor 2*a*. The radiation impedance of the double folded dipole antenna in FIG. 5B is 657 Ω because it becomes 9 times that of a non-folded dipole antenna, and the impedance of the double folded dipole slot antenna in FIG. 5A is 40.3 Ω. This value approximately matches a coaxial cable having a characteristic impedance of 50 Ω.

Figure 6:
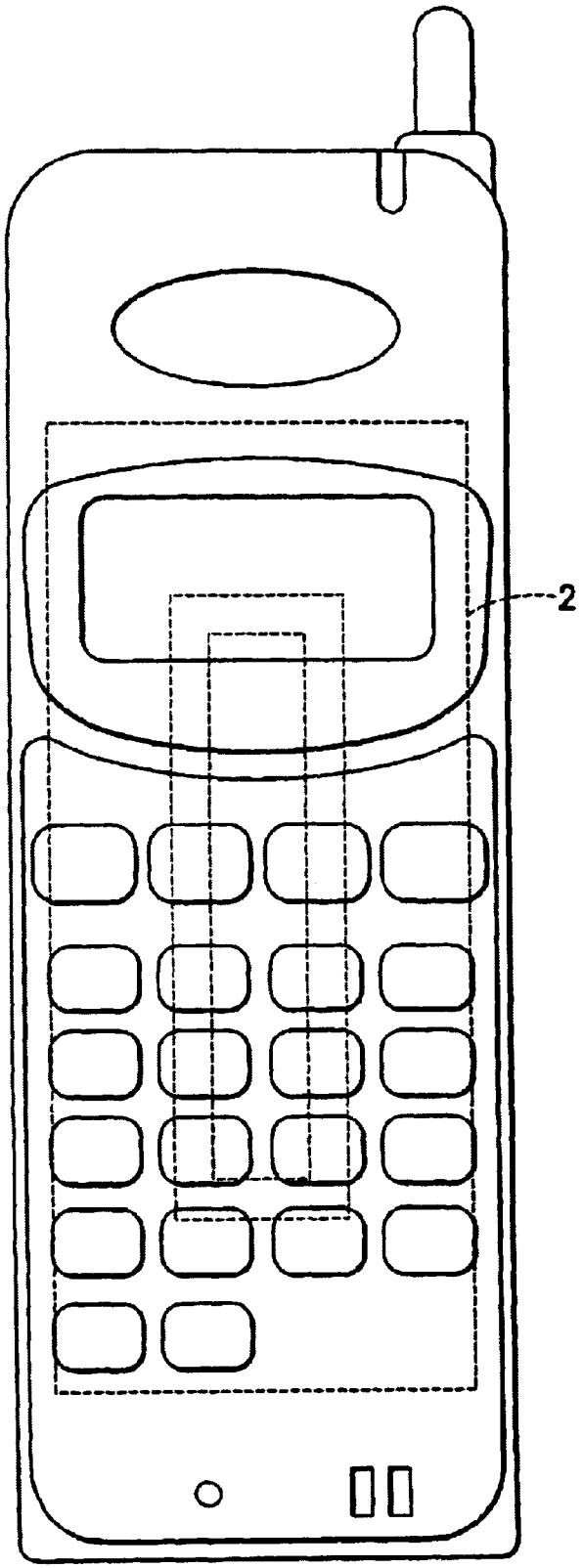
FIG. 6 is a diagram showing the antenna of this embodiment applied to a portable telephone.
Figure 7:
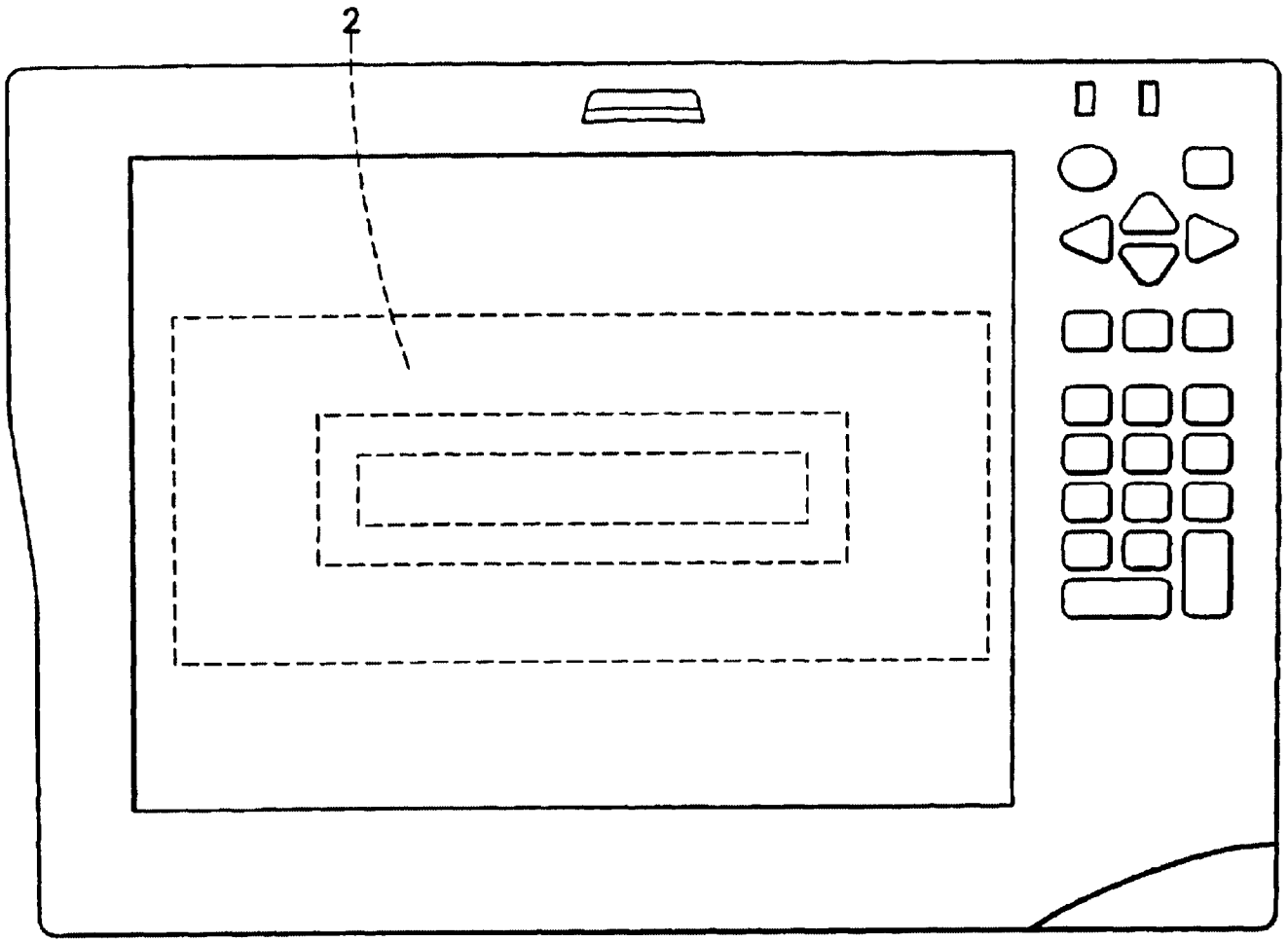
FIG. 7 is a diagram showing the antenna of this embodiment applied to a PDA.

In addition, in the aforementioned embodiment, the notebook-sized personal computer has been shown as an example, but the present invention is not limited to this. As illustrated in FIG. 6, the antenna 2 of the present invention may be mounted in a portable telephone. Note that the portable telephone, in addition to a cellular telephone, is assumed to include all possible telephones, which employ radio means, such as a personal handy phone system (PHS), etc. In addition, as illustrated in FIG. 7, the antenna 2 of the present invention may be mounted in personal digital assistants (PDA). Besides, it is not limited to notebook-sized personal computers, but may be applied to desktop and tower personal computers.

The computers are not limited to personal computers, but the antenna 2 is also applicable to workstations, etc. Furthermore, the antenna 2 of the present invention is not limited to an application to information processors, but is applicable to automobile radio systems, such as intelligent transport systems (ITSs), etc., television image-receiving systems, and other possible radio communication means.

In addition, the antenna 2 to which the present invention is applied is intended to employ a radio frequency of 2.4 GHz primarily. However, the present invention is not limited by radio frequency. For example, the invention is applicable to a television electronic wave signal with a frequency of 100 MHz, a portable telephone radio signal with a frequency of 900 MHz or 1.5 GHz, or radio communications with a frequency greater than that.

The major advantages obtained by the present invention are as follows: it can provide an aperture antenna that is matchable with a cable (transmission line) without employing any matching circuit (matching element); it can provide an aperture capable of allowing slight variations in machining; it can provide an aperture whose operating band is broad; and it can provide an aperture less liable to undergo the influences of operating circumstances or surrounding electric magnetic fields.

What is claimed is:

1. An antenna, comprising:

a first flat electric conductor with an aperture in which a second aperture length in a second direction perpendicular to a first direction is greater than a first aperture length in said first direction;

a second electric conductor, spaced from said first electric conductor, and disposed inside said aperture and tying in a plane substantially equal with said first electric conductor; and a non-balance type transmission line with its signal line connected to said second electric conductor and its ground line connected to said first electric conductor, wherein a center-to-center distance, in said second direction, of a gap between said first and second electric conductors is one half an electrical length in the frequency band of an electronic wave signal radiated.

2. The antenna according to claim 1, wherein a plurality of second electric conductors are spaced in said first direction.

3. The antenna according to claim 2, wherein a center-to-center distance, in said first direction between said plurality of second electric conductors, is in a range of 1/10 to 1/25 of said electrical length.

4. The antenna according to claim 1, wherein said signal line is connected to a center portion, in said second direction, of said second electric conductor.

5. The antenna according to claim 1, wherein the space of said gap is in a range of 1/50 to 1/150 of said electrical length.

6. The antenna according to claim 1, wherein a size, in said first direction, of said first electric conductor is 1/8 or more of said electrical length, and a size, in said second direction, of said first electric conductor is 5/8 or more of said electrical length.

7. The antenna according to claim 1, wherein said aperture and second electric conductor are rectangular in shape.

8. The antenna according to claim 1, wherein said first and second electric conductors are metallic films formed on a printed circuit board.

9. An information processor comprising a radio transmitting-receiving unit and an antenna connected to said radio transmitting-receiving unit, wherein said antenna comprises:

a first flat electric conductor with an aperture in which a second aperture length in a second direction perpendicular to a first direction is greater than a first aperture length in said first direction;

a second electric conductor, spaced from said first electric conductor, and disposed inside said aperture and lying in a plane substantially equal with said first electric conductor; and a non-balance type transmission line with its signal line connected to said second electric conductor and its ground line connected to said first electric conductor, wherein a center-to-center distance, in said second direction, of a gap between said first and second electric conductors is one half an electrical length in the frequency band of an electronic wave signal radiated.

10. The information processor according to claim 9, wherein in said aperture, a plurality of second electric conductors are spaced in said first direction and disposed.

* * * * *